US006554918B2

(12) United States Patent
Kashima et al.

(10) Patent No.: US 6,554,918 B2
(45) Date of Patent: Apr. 29, 2003

(54) HIGH-STRENGTH HOT-ROLLED STEEL SHEET SUPERIOR IN STRETCH FLANGE FORMABILITY AND METHOD FOR PRODUCTION THEREOF

(75) Inventors: Takahiro Kashima, Kakogawa (JP); Shunichi Hashimoto, Kakogawa (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/909,908

(22) Filed: Jul. 23, 2001

(65) Prior Publication Data

US 2002/0036035 A1 Mar. 28, 2002

(30) Foreign Application Priority Data

Jul. 24, 2000 (JP) ..... 2000-221580

(51) Int. Cl.[7] ..... C22C 38/00
(52) U.S. Cl. ..... 148/320; 148/602; 420/8
(58) Field of Search ..... 148/320, 602; 420/8

(56) References Cited

U.S. PATENT DOCUMENTS 4,415,376 A * 11/1983 Bramfitt et al. ..... 148/320
4,472,208 A * 9/1984 Kunishige ..... 148/333

FOREIGN PATENT DOCUMENTS

| | | |
|---|---|---|
| JP | 53-88620 | 8/1978 |
| JP | 62-4450 | 1/1987 |
| JP | 63-66367 | 12/1988 |
| JP | 4-110418 | 4/1992 |
| JP | 11-106861 | 4/1999 |
| JP | 11-246931 | 9/1999 |
| JP | 11-246932 | 9/1999 |

* cited by examiner

*Primary Examiner*—Roy King
*Assistant Examiner*—Andrew Wessman
(74) *Attorney, Agent, or Firm*—Oblon, Spivak, McClelland, Maier & Neustadt, P.C.

(57) ABSTRACT

A high-strength hot-rolled steel sheet superior in stretch flange formability which comprises C (0.01–0.10 mass %), Si (no more than 1.0 mass %), Mn (no more than 2.5 mass %), P (no more than 0.08 mass %), S (no more than 0.005 mass %), Al (0.015–0.050 mass %), and Ti (0.10–0.30 mass %), with the remainder being substantially Fe, said hot-rolled steel sheet having a structure composed mainly of ferrite in which the unit grain is surrounded by grains such that adjacent grains differ in orientation more than 15°, the unit grain having an average particle diameter (d) no larger than 5 $\mu$m. This steel sheet is produced by the steps of heating, rolling, cooling, and coiling under the following conditions. Heating temperature: 1150–1300° C.; reduction in rolling at 900–840° C.: no less than 70%; cooling rate: no less than 60° C./s; and coiling temperature: 300–500° C. or 600–750° C.

13 Claims, No Drawings

HIGH-STRENGTH HOT-ROLLED STEEL SHEET SUPERIOR IN STRETCH FLANGE FORMABILITY AND METHOD FOR PRODUCTION THEREOF

BACKGROUND OF THE INVENTION

1. Field of the Invention

The present invention relates to a high-strength hot-rolled steel sheet superior in stretch flange formability and a method for production thereof, said steel sheet being suitable for use as a raw material for automotive parts such as chassis and suspension systems (including arms and members).

2. Description of the Related Art

A recent trend in the field of automobile and industrial machine is toward the reduction in weight of parts, which is achieved by using high-strength hot-rolled steel sheet. Such steel sheet often needs good stretch flange formability (local elongation) because it undergoes pressing for hole expansion as well as shaping.

It is known that Ti-containing hot-rolled steel sheets have high strength and good workability as disclosed in Japanese Patent Laid-open Nos. 88620/1978 and 106861/1999 and Japanese Patent Publication Nos. 4450/1987, 66367/1988, and 110418/1992. However, these disclosures are not concerned at all with the structure desirable for improved stretch flange formability.

Serious attempts are being made to obtain a steel sheet having an extremely fine grained structure in which the unit grain is smaller than several micrometers in size (each unit grain being surrounded by adjacent grains whose crystal orientation is larger than 15°), as disclosed in Japanese Patent Laid-open Nos. 246931/1999 and 246932/1999. Up to date, such attempts are unsuccessful in obtaining fine-grained steel sheets having good stretch flange formability.

OBJECT AND SUMMARY OF THE INVENTION

The present invention was completed to address the above-mentioned problems. It is an object of the present invention to provide a hot-rolled steel sheet having high strength as well as good stretch flange formability. It is another object of the present invention to provide a method for producing the hot-rolled steel sheet.

The present inventors found that a hot-rolled steel sheet exhibits good stretch flange formability without its high strength being impaired if it contains 0.10–0.30% of Ti and does not substantially contain the second phase (such as martensite and bainite resulting from transformation at low temperatures) except for ferrite and has a single-phase structure of ferrite with a controlled grain size and shape. The present invention is based on this finding. The gist of the present invention resides in a high-strength hot-rolled steel sheet superior in stretch flange formability which comprises C (0.01–0.10 mass %), Si (no more than 1.0 mass %), Mn (no more than 2.5 mass %), P (no more than 0.08 mass %), S (no more than 0.005 mass %), Al (0.015–0.050 mass %), and Ti (0.10–0.30 mass %), with the remainder being substantially Fe, said hot-rolled steel sheet having a structure composed mainly of ferrite wherein the unit grain has an average particle diameter (d) no larger than 5 $\mu$m, said unit grain being defined such that adjacent grains which surround said unit grain differ from solid unit grain in orientation more than 15°.

In a preferred embodiment of the present invention, the high-strength hot-rolled steel sheet is characterized in that the unit grain adjoins its surrounding grains along a boundary whose average length (L) is such that L/d is no smaller than 4.0. This condition is necessary for improved stretch flange formability.

In another preferred embodiment of the present invention, the high-strength hot-rolled steel sheet further comprises at least one of Nb in an amount not more than 0.40 mass %, B in an amount not more than 0.0010 mass %, and Ca in an amount not more than 0.01 mass %.

The gist of the present invention resides also in a method of producing a high-strength hot-rolled steel sheet, said method comprising the steps of heating and hot-rolling a steel sheet having the above-mentioned composition and coiling the hot-rolled steel sheet in such a way that the reduction is no less than 70% at the rolling temperature of 900–840° C. and the coiling temperature is 300–500° C. or 600–750° C. The requirement for L/d no smaller than 4.0 is met when the reduction is no less than 50%, and hence the resulting steel sheet has good stretch flange formability.

The hot-rolled steel sheet according to the present invention exhibits good stretch flange formability without its high strength being impaired owing to its specific composition in which ferrite accounts for a major portion, with a Ti content being 0.10–0.30%, and also owing to its specific structure in which the ferrite unit grain has a specific particle diameter or peripheral shape to prevent crack propagation. The method of the present invention permits easy production of said high-strength hot-rolled steel sheet.

DESCRIPTION OF THE PREFERRED EMBODIMENTS

The high-strength hot-rolled steel sheet of the present invention should have the above-mentioned specific chemical composition for the reasons given below. ("%" means "mass %".)

C: 0.01–0.10%

C is an essential element to improve strength. C in excess of 0.10% tends to form the second phase structure. Therefore, the lower limit of the C content should be 0.01%, preferably 0.02%, and the upper limit of the C content should be 0.10%, preferably 0.08%.

Si: no more than 1.0%

Si is an element to effectively increase the steel strength without deteriorating the steel ductility appreciably, although, if added in a large amount, it causes surface defects including scale defects and promotes generation of coarse ferrite grains which decreases L/d. The upper limit of the Si content should be 1.0%, preferably 0.8%.

Mn: no more than 2.5%

Mn is an element that contributes to solid-solution strengthening and in turn imparts strength to steel. It also promotes transformation, thereby forming granular bainitic ferrite and bainitic ferrite. It changes the shape of the grain boundary. It should preferably be added in an amount more than 0.5%; however, Mn added in an excess amount results in excessive hardenability, which leads to a large amount of transformation products detrimental to high stretch flange formability. Thus, the upper limit of the Mn content should be 2.5%, preferably 2.0%.

P: no more than 0.08%

P is an element that contributes to solid-solution strengthening without deteriorating ductility. However, P added in an excess amount raises the transition temperature after working. Therefore, the content of P should be no more than 0.08%.

S: no more than 0.005%

S forms sulfides (such as MnS) and inclusions detrimental to stretch flange formability. The content of S should be no more than 0.005%. The smaller, the better.

Al: 0.015–0.050%

Al is added as a deoxidizer. It produces little deoxdizing effect and promotes generation of non-metallic inclusions such as TiN by leaving much N, if its content is less than 0.015%. It forms non-metallic inclusions, such as $Al_2O_3$, detrimental to cleanliness if its content exceeds 0.050%. The content of Al should be 0.015–0.050%.

Ti: 0.10–0.30%

Ti improves hardenability and changes the particle diameter, thereby improving the stretch flange formability. The content of Ti should be no less than 0.10%, preferably no less than 0.20%, and should be no more than 0.30%, preferably no more than 0.25%. Excessive Ti is wasted without additional effects. In the hot-rolling of the steel sheet according to the present invention, Ti expands the unrecrystallized austenite region (as mentioned later) and accumulates the deformation strain energy which gives rise to fine grains and also to grains having zigzag grain boundaries both effective for stretch flange formability. This effect is produced most effectively when Ti is added. This effect is not produced when only Nb is added. If Ti content is too small, generation of ferrite is promoted and the zigzag boundaries are not obtained.

The high-strength hot-rolled steel sheet of the present invention is composed of the above-mentioned components, with the remainder being substantially Fe. It may contain, in addition to inevitable impurities, one or more of the following elements in an amount not harmful to the effect of the above-mentioned components.

Nb: no more than 0.40%

B: no more than 0.0010%

These elements, like Ti, improve hardenability and stretch flange formability due to grain size change. The content of Nb should be no more than 0.40%, preferably no more than 0.30%, and the content of B should be no more than 0.0010%, preferably no more than 0.0005%. Excessive Nb and B are wasted without additional effects.

Ca: no more than 0.01%

Ca reduces MnS detrimental to stretch flange formability and converts it into spherical sulfide (CaS) which is harmless to stretch flange formability. The content of Ca should be no more than 0.01%. Excessive Ca is wasted without additional effects.

The hot-rolled steel sheet of the present invention is characterized by its structure as explained below.

The steel sheet of the present invention is composed mainly of ferrite. It should not contain a second phase (such as martensite and bainite resulting from transformation at low temperatures), because ferrite differs in hardness from such a second phase and this difference gives rise to voids and cracks which deteriorate the stretch flange formability. The ferrite includes not only polygonal ferrite structure but also granular bainitic ferrite structure and bainitic ferrite structure. The typical form of these ferrites is known from "Collection of photographs of steel bainite (part 1)" issued by The Iron and Steel Institute of Japan, Fundamental Research Group. All the ferrite structure mentioned above should preferably be a single phase of ferrite. However, it may practically contain a second phase in an amount less than 5% (in terms of area ratio) with only little adverse effect on the stretch flange formability.

Ferrite seriously affects plastic deformation and hence stretch flange formability depending on its particle diameter and its grain boundary shape in the structure. The smaller the particle diameter becomes, the more crack propagation is hindered, because there are more grain boundaries through which cracking propagates. Irregular (or zigzag) grain boundaries provide greater boundary strength than straight or flat grain boundaries and hence effectively prevent boundary cracking at the time of deformation.

The foregoing is the reason why the present invention requires that the ferrite structure in the hot-rolled steel sheet be composed of unit grains having an average particle diameter (d) no larger than 5 $\mu$m, wherein all adjacent grains which surround said unit grain differ from said solid unit grain in orientation more than 150. With an average particle diameter (d) larger than 5 $\mu$m, ferrite grains do not effectively prevent crack propagation and hence do not contribute to stretch flange formability. For improved stretch flange formability, not only is it necessary that unit particles be fine but it is also necessary that each unit grain adjoins its surrounding grains along a boundary whose average length (L $\mu$m) is such that L/d is no smaller than 4.0. If this ratio is smaller than 4.0, the grain boundary is flat and hence produces little effect in preventing cracking at grain boundaries and improving stretch flange formability. The foregoing requirement is established because any unit grain surrounded by grains such that all adjacent grains differ in orientation less than 15° may be regarded substantially as a single grain from the standpoint of preventing crack propagation. Grain boundaries between grains which differ in orientation less than 15° provide little effect on crack propagation.

The particle diameter and boundary length of the unit grain can be determined by EBSP (Electron Back Scattering Pattern) method for measuring the crystal orientation on an etched steel surface. (Measurements are carried out under the condition of 2000 magnifications and 100 steps for 10 $\mu$m.) Measurements give a map showing a grain surrounded by grains all of which have an orientation difference larger than 15°. This map is finally examined by image analysis.

The term "average particle diameter" means an average value of the diameters of imaginary circles each having an area equal to that of a unit grain surrounded by grains all of which have an orientation difference larger than 15°.

According to the present invention, the high-strength hot-rolled steel sheet is produced by preparing a steel containing the above-mentioned components, heating and hot-rolling the steel slab and coiling the hot-rolled steel sheet in such a way that the reduction is no less than 70% at the rolling temperature of 900–840° C. and the coiling temperature is 300–500° C. or 600–750° C. Incidentally, the slab should be heated at about 1150–1300° C. so that Ti is completely dissolved to form solid solution. In the period from hot rolling (finish rolling) at 900–840° C. to coiling up, the hot-rolled steel sheet should be cooled to the specified temperature at a rate no smaller than 60° C./s, preferably no smaller than 80° C./s, so that ferrite is not generated.

In the case of a steel containing 0.10–0.30% of Ti, the rolling at 900° C. or below, in finish rolling that follows rough rolling, is usually carried out in the unrecrystallized austenite region in which recrystallization does not take place in the austenite region (or gamma region). Rolling with a reduction no less than 70% in this temperature range imparts sufficient deformation strain to the unrecrystallized austenite. If the rolling temperature is no higher than 840° C., the resulting steel sheet consists of two phases (ferrite and gamma regions) and hence is poor in stretch flange formability due to the presence of ferrite worked structure. For this reason, it is necessary that the reduction be no less than 70% at 900–840° C. Incidentally, the reduction in finish rolling or rough rolling at temperatures exceeding 900° C. is not specifically restricted because at such high temperatures the structure undergoes recrystallization which only imparts little deformation strain. In finish rolling at temperature exceeding 900° C., due to rolling in recrystallization region, coarse ferrite grains occur and desired L/d can not be obtained.

The hot-rolled steel sheet composed of unrecrystallized austenite is coiled at a specific temperature (mentioned later) so that fine ferrite grains differing in crystal orientation occurs rapidly during coiling. Thus, after coiling, the ferrite unit grains in the hot-rolled steel sheet have an average particle diameter no larger than 5 $\mu$m. With a reduction less than 70%, rolling does not cause the unrecrystallized austenite to accumulate sufficient strain energy, with the result that ferrite nucleating sites are limited in number, ferrite nucleation is slow, coarse ferrite grains occur, and ferrite unit grains are outside the prescribed size.

The reduction should preferably be no less than 80%. The steel sheet rolled with such a high reduction permits ferrite transformation to take place rapidly during coiling, with the resulting ferrite grains having an irregular grain boundary so that the value of L/d is no less than 4.0. The mechanism by which the crystal boundary becomes irregular is not yet elucidated; however, the present inventors observed that crystal grains became uneven and hence crystal boundaries became irregular when a steel incorporated with a certain an amount of Ti was rolled with a high reduction. This observation suggests the possibility of Ti playing an important role.

According to the present invention, the coiling temperature should be 300–500° C. (preferably 320–480° C.) or 600–750° C. (preferably 620–720° C.). Coiling at a temperature lower than 300° C. permits the second phase (such as martensite) to occur easily. By contrast, coiling at a temperature higher than 750° C. permits ferrite grains to grow to such an extent that the ferrite unit grain is larger than 5 $\mu$m. Coiling at temperatures higher than 500° C. and lower than 600° C. should be avoided because it permits the coherent precipitation of TiC on the matrix, which deteriorates the elongation and the stretch flange formability. The lower the coiling temperature or the higher the reduction in the unrecrystallized austenite region, the more effectively the ferrite crystal grains become fine.

EXAMPLES

The following examples are included merely to aid in the understanding of the invention, and variations may be made by one skilled in the art without departing from the spirit and scope of the invention.

Steels having the chemical composition shown in Table 1 were prepared. The slab of each steel was heated at 1250° C. for 30 minutes. The heated slab underwent rough rolling and finish rolling. Thus there was obtained a hot-rolled steel sheet, 2.5 mm thick. Table 2 shows the temperature at which finish rolling was started (FET), the temperature at which finish rolling was completed (FDT), and the reduction (R) in finish rolling. After the finish rolling was complete, the rolled steel sheet was cooled with mist (at a cooling rate of 65° C./s) and finally coiled at the coiling temperature (CT) shown in Table 2.

Test specimens conforming to JIS No. 5 were taken from the hot-rolled steel sheets. They were tested for tensile strength (TS) in the rolling direction. They were also tested for stretch flange formability by hole expansion. The hole expansion test consists of punching a hole (10 mm in diameter) in the specimen and forcing a conical punch (with an apex angle of 60°) into the hole. When the specimen cracks across its thickness, the diameter (d) of the expanded hole is measured. The result is expressed in terms of the ratio ($\lambda$) of hole expansion calculated from the following formula.

$$\lambda=[(d-d_1)/10]\times 100\%, \text{ where } d_0=10\ mm$$

The results are shown in Table 2.

Specimens for structure observation were taken from the rolled steel sheets. They were examined under an SEM to identify the kind of structure and to calculate the ratio of ferrite area. They were also examined by EBSP method to make a crystal orientation map. Unit grains whose orientation difference is smaller than 15° were measured for particle diameter ($d_0$) and grain boundary length ($L_0$). The average value (d) of $d_0$ and the average value (L/d) of $L_0/d_0$ were calculated. The results are shown in Table 2. Incidentally, the ferrite structure in Table 2 is identified by pF (polygonal ferrite) and bF (bainitic ferrite). Those samples numbered 10, 24, and 34 are identical but are given different numbers for data arrangement.

TABLE 1

| Sample | Chemical composition (mass %), remainder substantially Fe | | | | | | | | | | |
|---|---|---|---|---|---|---|---|---|---|---|---|
| No. | C | Si | Mn | S | P | Ti | Nb | Al | B | Ca | Note |
| 1 | 0.120 | 0.5 | 1.5 | 0.002 | 0.010 | 0.20 | — | 0.035 | — | — | ** |
| 2 | 0.070 | 0.5 | 1.5 | 0.002 | 0.010 | 0.21 | — | 0.033 | — | — | * |
| 3 | 0.030 | 0.5 | 1.5 | 0.002 | 0.010 | 0.22 | — | 0.032 | — | — | * |
| 4 | 0.005 | 0.5 | 3.0 | 0.002 | 0.010 | 0.23 | — | 0.034 | — | — | ** |
| 5 | 0.070 | 0.5 | 0.3 | 0.002 | 0.010 | 0.21 | 0.24 | 0.028 | — | — | * |
| 6 | 0.065 | 0.5 | 1.5 | 0.002 | 0.010 | 0.24 | — | 0.034 | 0.0012 | — | * |
| 7 | 0.055 | 0.5 | 1.5 | 0.002 | 0.010 | 0.20 | — | 0.030 | — | 0.0009 | * |
| 8 | 0.055 | 0.5 | 1.5 | 0.002 | 0.010 | — | — | 0.030 | — | — | ** |
| 9 | 0.055 | 1.5 | 1.5 | 0.002 | 0.010 | 0.20 | — | 0.030 | — | — | ** |
| 10 | 0.055 | 0.5 | 1.5 | 0.002 | 0.010 | 0.05 | — | 0.030 | — | — | ** |
| 11 | 0.055 | 0.5 | 1.5 | 0.002 | 0.010 | 0.15 | — | 0.030 | — | — | * |
| 12 | 0.055 | 0.5 | 1.5 | 0.002 | 0.010 | 0.28 | — | 0.030 | — | — | * |
| 13 | 0.055 | 0.5 | 1.5 | 0.002 | 0.010 | 0.35 | — | 0.030 | — | — | ** |
| 14 | 0.055 | 0.5 | 1.5 | 0.002 | 0.010 | 0.22 | — | 0.010 | — | — | ** |
| 15 | 0.055 | 0.5 | 1.5 | 0.002 | 0.010 | 0.22 | — | 0.020 | — | — | * |
| 16 | 0.055 | 0.5 | 1.5 | 0.002 | 0.010 | 0.22 | — | 0.045 | — | — | * |
| 17 | 0.055 | 0.5 | 1.5 | 0.002 | 0.010 | 0.22 | — | 0.055 | — | — | ** |

TABLE 1-continued

| Sample | Chemical composition (mass %), remainder substantially Fe | | | | | | | | | | |
|---|---|---|---|---|---|---|---|---|---|---|---|
| No. | C | Si | Mn | S | P | Ti | Nb | Al | B | Ca | Note |
| 18 | 0.055 | 0.5 | 1.5 | 0.002 | 0.010 | 0.22 | 0.35 | 0.030 | — | — | * |
| 19 | 0.055 | 0.5 | 1.5 | 0.002 | 0.010 | 0.22 | — | 0.030 | 0.0005 | — | * |
| 20 | 0.055 | 0.5 | 1.5 | 0.002 | 0.010 | 0.22 | — | 0.030 | — | 0.002 | * |

Note:
*Samples according to the present invention
**Samples for comparison
"—" means "not added"

TABLE 2

| Sample | Steel | FET | FDT | CT | R | D | | Ferrite structure | | TS | λ | TS × λ | CR |
|---|---|---|---|---|---|---|---|---|---|---|---|---|---|
| No. | No. | (° C.) | (° C.) | (° C.) | (%) | (μm) | L/d | Type | % | (N/mm$^2$) | (%) | (N/mm$^2$-%) | (° C./s) |
| 1* | 1 | 890 | 850 | 450 | 75 | 4.1 | 3.2 | bF | 90 | 800 | 48 | 38400 | 65 |
| 2 | 2 | 890 | 850 | 450 | 75 | 4.3 | 3.1 | bF | 96 | 730 | 66 | 48180 | 65 |
| 3 | 3 | 890 | 850 | 450 | 75 | 4.8 | 3.2 | pF | 98 | 570 | 80 | 45600 | 65 |
| 4* | 4 | 890 | 850 | 450 | 75 | 10.0 | 3.2 | pF | 96 | 480 | 75 | 36000 | 65 |
| 5 | 5 | 890 | 850 | 450 | 75 | 4.3 | 3.1 | bF | 98 | 720 | 61 | 43920 | 65 |
| 6 | 6 | 890 | 850 | 450 | 75 | 4.2 | 3.2 | bF | 96 | 753 | 65 | 48945 | 65 |
| 7 | 7 | 890 | 850 | 450 | 75 | 4.3 | 3.1 | bF | 97 | 710 | 60 | 42600 | 65 |
| 8* | 8 | 890 | 850 | 450 | 75 | 8.1 | 2.8 | pF | 98 | 760 | 55 | 41800 | 65 |
| 9 | 2 | 890 | 850 | 450 | 75 | 4.2 | 4.8 | bF | 98 | 782 | 91 | 71162 | 65 |
| 10 | 3 | 890 | 850 | 450 | 75 | 3.9 | 4.2 | bF | 98 | 791 | 92 | 72772 | 65 |
| 11 | 5 | 890 | 850 | 450 | 75 | 4.0 | 5.1 | bF | 96 | 822 | 93 | 76446 | 65 |
| 12 | 6 | 890 | 850 | 450 | 75 | 4.3 | 4.6 | bF | 98 | 811 | 95 | 77045 | 65 |
| 13 | 7 | 890 | 850 | 450 | 75 | 4.2 | 4.8 | bF | 99 | 789 | 93 | 73377 | 65 |
| 21* | 3 | 890 | 850 | 800 | 75 | 7.3 | 4.9 | pF | 99 | 630 | 56 | 53280 | 65 |
| 22 | 3 | 890 | 850 | 650 | 75 | 4.5 | 5.0 | pF | 98 | 765 | 92 | 70380 | 65 |
| 23* | 3 | 890 | 850 | 550 | 75 | 4.3 | 4.5 | bF | 99 | 830 | 45 | 37350 | 65 |
| 24 | 3 | 890 | 850 | 450 | 75 | 3.9 | 4.2 | bF | 98 | 791 | 92 | 72772 | 65 |
| 31* | 3 | 890 | 850 | 450 | 10 | 6.2 | 3.1 | bF | 97 | 790 | 53 | 41870 | 65 |
| 32* | 3 | 890 | 850 | 450 | 20 | 6.1 | 3.2 | bF | 98 | 785 | 55 | 43175 | 65 |
| 33 | 3 | 890 | 850 | 450 | 40 | 4.8 | 3.2 | bF | 98 | 570 | 80 | 45600 | 65 |
| 34 | 3 | 890 | 850 | 450 | 60 | 3.9 | 4.2 | bF | 98 | 791 | 92 | 72772 | 65 |
| 35 | 3 | 890 | 850 | 450 | 80 | 3.9 | 4.6 | bF | 97 | 789 | 93 | 73377 | 65 |
| 36* | 9 | 890 | 850 | 450 | 75 | 6.0 | 3.1 | pF | 80 | 690 | 100 | 69000 | 65 |
| 37* | 10 | 890 | 850 | 450 | 75 | 4.1 | 3.4 | pF | 70 | 570 | 100 | 57000 | 65 |
| 38 | 11 | 890 | 850 | 450 | 75 | 4.2 | 4.2 | bF | 98 | 780 | 97 | 75660 | 65 |
| 39 | 12 | 890 | 850 | 450 | 75 | 3.2 | 4.9 | bF | 99 | 791 | 100 | 79100 | 65 |
| 40* | 13 | 890 | 850 | 450 | 75 | 3.0 | 5.0 | bF | 97 | 790 | 84 | 66360 | 65 |
| 41* | 14 | 890 | 850 | 450 | 75 | 3.1 | 5.0 | bF | 99 | 781 | 52 | 40612 | 65 |
| 42 | 15 | 890 | 850 | 450 | 75 | 3.0 | 5.0 | bF | 98 | 792 | 95 | 75240 | 65 |
| 43 | 16 | 890 | 850 | 450 | 75 | 3.2 | 4.8 | bF | 97 | 781 | 97 | 75757 | 65 |
| 44* | 17 | 890 | 850 | 450 | 75 | 3.0 | 4.9 | bF | 98 | 782 | 42 | 32844 | 65 |
| 45 | 18 | 890 | 850 | 450 | 75 | 2.8 | 4.7 | bF | 97 | 781 | 105 | 82005 | 65 |
| 46 | 19 | 890 | 850 | 450 | 75 | 2.9 | 4.6 | bF | 98 | 791 | 98 | 77518 | 65 |
| 47 | 20 | 890 | 850 | 450 | 75 | 3.1 | 4.6 | bF | 98 | 785 | 110 | 86350 | 65 |
| 48* | 3 | 920 | 850 | 450 | 75 | 6.1 | 3.1 | bF | 97 | 621 | 48 | 29808 | 65 |
| 49* | 3 | 890 | 820 | 450 | 75 | — | — | F** | — | 910 | 10 | 9100 | 65 |
| 50* | 3 | 890 | 850 | 250 | 75 | 3.1 | 4.0 | bF + (M) | 80 | 920 | 30 | 27600 | 65 |
| 51 | 3 | 890 | 850 | 450 | 90 | 3.5 | 4.8 | bF | 98 | 790 | 100 | 79000 | 65 |
| 52* | 3 | 890 | 850 | 450 | 80 | 3.0 | 3.1 | pF | 99 | 670 | 55 | 36850 | 50 |

Comparative samples are indicated by asterisked numbers.
F**: worked ferrite

It is noted from Table 2 that samples Nos. 1, 4, 8, 36, 37, 40, 41, and 44, which were prepared from steels Nos. 1, 4, 8, 9, 10, 13, 14, and 17 each composed of components not conforming to the present invention, are remarkably poor in tensile strength TS or λ. Particularly, sample No. 1 is characterized by the structure not dominated by ferrite (with 10% martensite) owing to its high C content, and hence it has a very low value of λ. Sample No. 21 is characterized by coarse grains (with a large value of d) owing to the high coiling temperature. Sample No. 23 is characterized by the precipitation of TiC and the low value of λ owing to the inadequate coiling temperature. Samples Nos. 31 and 32 are characterized by coarse grains (with a large value of d) and a low value of λ owing to an excessively low reduction in the unrecrystallized austenite region despite the adequate coiling temperature. Sample No. 36 is characterized by a low value of L/d owing to a high Si content which promotes ferrite formation. Sample No. 37 is characterized by a low value of L/d owing to a low Ti content which promotes ferrite formation. Sample No. 40 is characterized by a low value of λ owing to a high Ti content which leads to a large amount of TiO and TiN inclusion. Sample No. 41 is characterized by a low value of k owing to a high Al content which leads to a large amount of TiN inclusion. Sample No. 44 is characterized by a low value of λ owing to a high Al content which leads to a large amount of $Al_2O_3$ inclusion.

Sample No. 48 is characterized by a high value of FET, a large value of d, and a low value of λ. Sample No. 49 is characterized by a low value of FDT, worked structure, and a low value of λ. Sample No. 50 is characterized by a low value of CT and a low value of L/d. Sample No. 52 is characterized by a low value of CR, a large value of d, and a low value of λ.

By contrast, those samples (indicated by asterisked sample numbers) satisfying the requirements of the present invention have a high strength (570 $N/mm^2$ or above), a high value of λ (60% or above), and good stretch flange formability. Particularly, those samples (Nos. 9–13, 22, 24, 34, and 35) which are characterized by d lower than 5 μm and L/d higher than 4.0 have a value of λ higher than 90% and a value of TS×λ higher than 70000 $N/mm^2$%, and they are also superior in strength and stretch flange formability.

What is claimed is:

1. A high-strength hot-rolled steel sheet superior in stretch flange formability, comprising:

0.01–0.10 mass % of C;

no more than 1.0 mass % of Si;

no more than 2.5 mass % of Mn;

no more than 0.08 mass % of P;

no more than 0.005 mass % of S;

0.015–0.050 mass % of Al and 0.10–0.30 mass % of Ti, wherein a remainder is substantially Fe;

wherein said hot-rolled steel sheet has a single-phase structure of ferrite;

wherein a unit grain has an average particle diameter (d) no larger than 5 μm; and wherein said unit grain is defined such that adjacent grains which surround said unit grain differ from said unit grain in orientation more than 15°.

2. The high-strength hot-rolled steel sheet according to claim 1, wherein said unit grain adjoins its surrounding grains along a boundary; and wherein an average length (L) of the boundary is such that Lid is no smaller than 4.0.

3. The high-strength hot-rolled steel sheet according to claim 1, further comprising at least one of Nb in an amount not more than 0.40 mass % and B in an amount not more than 0.0010 mass %.

4. The high-strength hot-rolled steel sheet according to claim 1, further comprising Ca in an amount not more than 0.01 mass %.

5. The high-strength hot-rolled steel sheet according to claim 1, wherein said hot-rolled steel sheet is obtained by steps of heating, rolling, cooling, and coiling, where a heating temperature is 1150–1300° C., a reduction in rolling at 900–840° C. is no less than 70%, a cooling rate is no less than 60° C./s, and a coiling temperature is 300–500° C. or 600–750° C.

6. A method of producing the high-strength hot-rolled steel sheet of claim 1 from a steel sheet, the method comprising steps of heating, rolling, cooling, and coiling, where a heating temperature is 1150–1300° C., a reduction in rolling at 900–840° C. is no less than 70%, a cooling rate is no less than 60° C./s, and a coiling temperature is 300–500° C. or 600–750° C.

7. The high-strength hot-rolled steel sheet according to claim 1, comprising 0.20–0.30 mass % of Ti.

8. The high-strength hot-rolled steel sheet according to claim 1, comprising 0.21–0.30 mass % of Ti.

9. The high-strength hot-rolled steel sheet according to claim 1, comprising 0.22–0.30 mass % of Ti.

10. The high-strength hot-rolled steel sheet according to claim 1, comprising 0.24–0.30 mass % of Ti.

11. The high-strength hot-rolled steel sheet according to claim 1, comprising 0.20–0.25 mass % of Ti.

12. A high-strength hot-rolled steel sheet superior in stretch flange formability, comprising:

0.01–0.10 mass % of C;

no more than 1.0 mass % of Si;

no more than 2.5 mass % of Mn;

no more than 0.08 mass % of P;

no more than 0.005 mass % of S;

0.0 15–0.050 mass % of Al and 0.10–0.30 mass % of Ti, wherein a remainder is substantially Fe;

wherein said hot-rolled steel sheet has a structure consisting of at least one of a polygonal ferrite structure, a granular bainitic ferrite structure and a bainitic ferrite structure;

wherein a unit grain has an average particle diameter (d) no larger than 5 μm; and wherein said unit grain is defined such that adjacent grains which surround said unit grain differ from said unit grain in orientation more than 15°.

13. A high-strength hot-rolled steel sheet superior in stretch flange formability, comprising:

0.01–0.10 mass % of C;

no more than 1.0 mass % of Si;

no more than 2.5 mass % of Mn;

no more than 0.08 mass % of P;

no more than 0.005 mass % of S;

0.0 15–0.050 mass % of Al and 0.10–0.30 mass % of Ti, wherein a remainder is substantially Fe;

wherein said hot-rolled steel sheet has structure consisting essentially of ferrite;

wherein a unit grain has an average particle diameter (d) no larger than 5 μm; and wherein said unit grain is defined such that adjacent grains which surround said unit grain differ from said unit grain in orientation more than 15°.

* * * * *